US008752227B2

(12) United States Patent
Manning

(10) Patent No.: US 8,752,227 B2
(45) Date of Patent: Jun. 17, 2014

(54) POWER DRIVEN DUSTER AND CLEANER APPARATUS

(75) Inventor: Paul D. Manning, Gonzales, LA (US)

(73) Assignee: Crown Down Cleaners, LLC, Gonzales, LA (US)

( * ) Notice: Subject to any disclaimer, the term of this patent is extended or adjusted under 35 U.S.C. 154(b) by 28 days.

(21) Appl. No.: 13/482,113

(22) Filed: May 29, 2012

(65) Prior Publication Data

US 2013/0318730 A1 Dec. 5, 2013

(51) Int. Cl.
*A46B 13/02* (2006.01)
*A46B 17/02* (2006.01)

(52) U.S. Cl.
USPC ..... 15/22.1; 15/23; 15/28; 15/97.1; 15/144.3

(58) Field of Classification Search
USPC ..... 15/97.1, 22.1, 22.2, 23, 28, 144.3; 81/177.2
See application file for complete search history.

(56) References Cited

U.S. PATENT DOCUMENTS

| | | | | |
|---|---|---|---|---|
| 2,413,551 | A * | 12/1946 | Englund | 451/532 |
| 5,423,102 | A | 6/1995 | Madison | |
| 6,170,107 | B1 * | 1/2001 | George et al. | 15/24 |
| 6,295,681 | B1 | 10/2001 | Dolah | |
| 7,086,115 | B1 | 8/2006 | Rex et al. | |
| 7,958,587 | B1 * | 6/2011 | Hansen | 15/23 |
| 2004/0173059 | A1 * | 9/2004 | Klein et al. | 81/177.2 |
| 2006/0185104 | A1 * | 8/2006 | Le | 15/22.1 |
| 2006/0248666 | A1 * | 11/2006 | Lies | 15/23 |
| 2006/0282978 | A1 | 12/2006 | Kertz | |
| 2008/0022484 | A1 | 1/2008 | Caruso | |
| 2008/0087297 | A1 | 4/2008 | Rahbar-Dehghan | |
| 2008/0250570 | A1 * | 10/2008 | Dayton et al. | 7/170 |
| 2008/0250584 | A1 * | 10/2008 | Farkas et al. | 15/23 |
| 2009/0172912 | A1 | 7/2009 | Knopow | |
| 2009/0209181 | A1 * | 8/2009 | Burnett et al. | 451/344 |
| 2009/0255071 | A1 * | 10/2009 | Jones | 15/29 |
| 2010/0005607 | A1 | 1/2010 | DelaBarre | |
| 2011/0036373 | A1 | 2/2011 | Hilton | |

* cited by examiner

*Primary Examiner* — Mark Spisich
*Assistant Examiner* — Andrew A Horton
(74) *Attorney, Agent, or Firm* — Roy Kiesel Ford Doody & Thurmon APLC

(57) ABSTRACT

A hand held dusting apparatus for use with a motor provided with a rotating axle, such as a variable speed drill, includes an elongated extension member attachable at one end to the rotating axle and a dusting member having a body section attachable to the opposite end of the elongated extension member and a dusting section constructed having multiple strands of synthetic fiber materials extending from the body section. In a preferred embodiment the apparatus further includes a tubular hand guide member fitted about the extension member and constructed to slide along the extension member. In another preferred embodiment the body of dusting section has a mid-section that can be pivoted to allow the dusting elements to rotate about an axis set at an angle to the axis of the extension member.

13 Claims, 3 Drawing Sheets

POWER DRIVEN DUSTER AND CLEANER APPARATUS

BACKGROUND OF THE INVENTION

1. Field of the Invention

This invention relates in general to apparatus for dusting or cleaning, and more particular to power driven apparatus for dusting or cleaning.

2. Prior Art

The cleaning of homes, commercial office building or other similar structures has provided the cleaning industry with many challenging dusting or cleaning issues. One such issue is removing the dust from narrow ledges, such as floor molding, wainscoting and other similar structures so that it can be vacuumed and removed from the building. Other such difficult dusting structures would include various crevices and corner areas common in these structures. Also three-dimensional decorative areas in furniture contained in these structures or on the edge of paintings, taperistries or other wall mounted art objects are further examples of problem areas. Currently, it is necessary to use rags or other cloth materials to hand rub the dust catching areas. This is a very time consuming process that in many cases achieves unsatisfactory results. Another time consuming situation occurs when dusting table or desk surfaces having various small objects positioned on the surfaces. In such situations it necessary to either remove or otherwise secure the objects before the surfaces are dusted in order to avoid breakage of the objects or knocking them to the floor.

Safety and other issues arise when trying to dust areas that are above the reach of the cleaning person that requires the person to climb a ladder to reach the areas, or near the floor that requires the cleaning person to stoop or get on their knees to reach the areas. In addition to the safety issues, the dusting process is very time consuming.

It would also be beneficial to the cleaning industry if a device was constructed that not only dusted, but could also be utilized to polish or clean the structure. Another beneficial feature for a device needed by the cleaning industry would be the ability not only to dust, but also to clean a wide variety of surfaces so as to service multi-purpose functions. A still further beneficial feature would be the ability to utilize the device around electrical outlets or to dust and clean electrical components of equipment while minimizing the risk of shocking the person utilizing the device. Another beneficial feature would be the ability to utilize the device to also clean exterior surfaces such as concrete driveways or car rims or similar surfaces.

OBJECTS AND SUMMARY OF THE INVENTION

Therefore, one object of this invention is to provide a hand held device that can satisfactorily and quickly remove dust from molding, wainscoting and similar ledges, as well as from crevices, corners and other non-flat surfaces such as three-dimensional decorative forms on furniture and similar articles.

Another object of this invention is to provide a hand held device that can dust or clean surfaces, such as crown molding or top surfaces of tall furniture, that are above the normal reach of a person.

Still another object of this invention is to provide a hand held device that can safely clean the top edges of paintings, taperistries and other hung objects without knocking them to the floor.

A further object of this invention is to provide a hand held device that can clean low or floor level surfaces without the person having to stoop or get on their knees to reach the surfaces.

A still further object of this invention is to provide a device that can clean or apply polish to a surface at the same time the surface is being dusted.

A still further object of this invention is to provide a device that can clean a wide variety of surfaces whether located indoor or outdoors.

These and other objects of this invention shall become apparent from the ensuing descriptions of the invention.

Accordingly, a hand held apparatus for dusting, cleaning and/or polishing is provided having an elongated extension member operatively attachable at one end to a motor to cause the elongated extension member to rotate when the motor is activated and a dusting member attachable to an opposite end of the elongated extension member to rotate in synchronization with the elongated extension member. In a preferred embodiment the apparatus further includes a tubular hand guide member constructed to fit about and to slide along the elongated extension member. In another alternate embodiment the apparatus also includes a dust and fluid shield attachable to the extension member at a position between the dusting member and the motor to prevent dust or fluid generated during the dusting operation from harming the motor. In still another alternate embodiment the apparatus further includes a pivot connector attached to the dusting member to permit the dusting member to be angled from the central axis of the extension members, The foregoing has outlined rather broadly the features and technical advantages of the present invention in order that the detailed description of the invention that follows may be understood. Additional features and advantages of the invention will be described hereinafter which form the subject of the claims of the invention. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings illustrate a preferred embodiment of this invention. However, it is to be understood that this embodiment is not intended to be exhaustive, nor limiting of the invention. It is but one example of the construction of this invention.

PREFERRED EMBODIMENTS OF THE INVENTION

Figure 1:
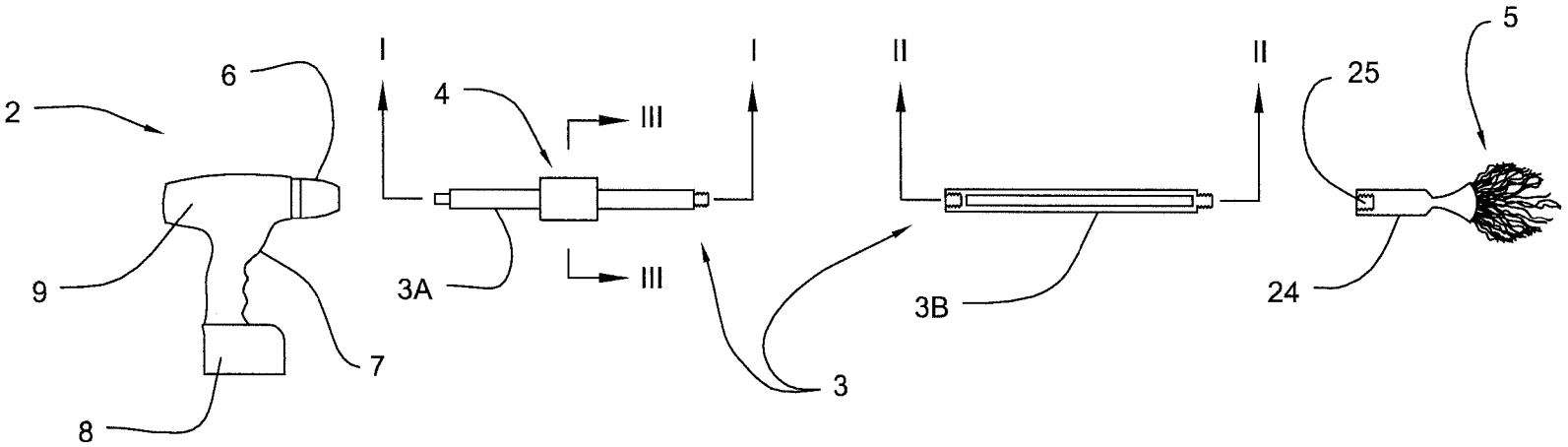
FIG. 1 is an exploded view of one preferred embodiment of this invention.

Without any intent to limit the scope of this invention, reference is made to the figures in describing the preferred embodiments of the invention.

Referring now to the figures, the preferred embodiment of hand held apparatus 1 includes a conventional electric drill 2, at least one elongated, tubular extension member 3, a tubular hand guide member 4 constructed to glidingly fit along the extension member 3, and a dusting member 5.

Drill 2 has a chuck 6 that rotates when the drill 2 is activated by switch 7 that controls the battery 8 to electrically connect to the drill motor 9. It is preferred that drill 2 be cordless to eliminate extension cords that would have to be plugged into a wall socket. It is also preferred that drill 2 be a variable speed drill having multiple torque settings to provide better control over the rotational speed and the torque that is delivered to the dusting member 5.

The number of elongated extension members 3 that are utilized depends on the need to position the dusting member 5 in close proximity to the area to be dusted or cleaned. In FIG. 1 two members 3A and 3B are illustrated. If additional members are desired, then additional members constructed similar to member 3B may be used to provide additional extension. Preferably, each member 3 is 1-3 feet in length, although greater lengths can be used. If a single member 3 is to be used it is preferred that member 3 be 24 inches to 36 inches in length to provide less fatigue during most uses. The construction of each member 3 should result in a member that is sufficiently rigid not to bend during its rotation and as lightweight as possible to reduce operator arm fatigue during its use. It is also preferred that each member 3 be tubular in shape and having a center cavity 10 extending along its length to decrease the weight of the member 3 to permit easier and less tiring use of the dusting apparatus 1. It is also preferred that each member 3 be constructed of light weight material such as aluminum or rigid plastic, and more preferably of a material that is non-conducting of electricity. In an alternate embodiment extension member 3 may have two or more sections that telescope within one another and can be locked in the desired extension position by conventional means.

Figure 5:
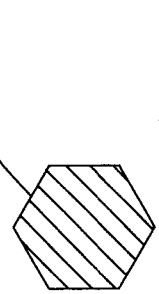
FIG. 5 is a cross-sectional view taken along lines IV-IV of the hex shaped shaft of the first extension member that is attachable to the chuck of power drill as illustrated in FIG. 1.
Figure 2:
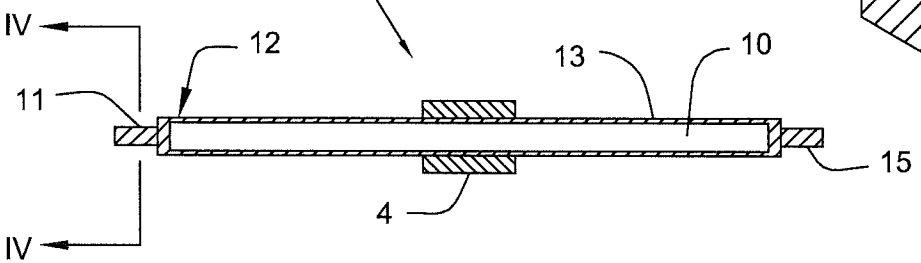
FIG. 2 is a cross-sectional view taken along lines I-I of the preferred embodiment of the first extension member attachable to the power means as illustrated in FIG. 1.

FIG. 2 illustrates the preferred embodiment of the extension member 3A that is to be attached to drill 2. In this embodiment shaft 11 extends perpendicularly from one end section 12 of the elongated hollow body 13. Shaft 11 is preferably sufficient long to extend into chuck 6 and has a cross-sectional shape that permits chuck 6 to grasp and securely hold shaft 11 in chuck 6 during the dusting and cleaning operation. FIG. 5 illustrates shaft 11 having a preferred hexagonal cross-section that fits into the chuck of most commercially available drills. Another common polygon shape includes a square cross-section. Perpendicularly extending from opposite end section 14 of body 13 is threaded shaft 15 that will operatively connect the elongated member 3A to either a second elongated member 3B or to dusting member 5.

Figure 3:
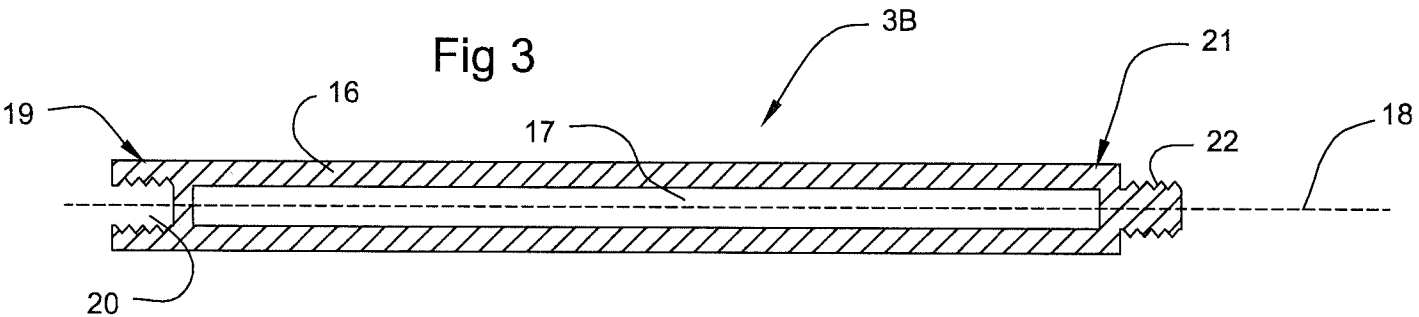
FIG. 3 is a cross-sectional view taken along lines II-II of the second extension member attachable to the first extension member and to the dusting member as illustrated in FIG. 1.

FIG. 3 illustrates the preferred construction of the second elongated member 3B. This construction can also be utilized if there are to be more than two elongated members 3. Member 3B is constructed having an elongated tubular body 16 provided with cavity 17 extending along the central axis 18 of member 3B. Extending parallel to central axis 18 in a first end section 19 of body 16 is an internally threaded female cavity 20 to operatively receive exteriorly threaded shaft 15 for the purpose of connecting member 3A to member 3B. In a preferred embodiment each member 3 will have substantially identical cross-sections to permit hand guide member 4 to easily slide from one member 3 to another member 3 for positioning at a desired location to better control the positioning and movement of dusting member 5 during the dusting operation. Extending perpendicularly from the opposite end section 21 is a threaded shaft 22 sized and shaped to operatively attach the dusting member 5 to member 3B. Alternative to the use of a threaded shaft and threaded receiving cavity is the use of conventional ball detent structure to connect extension members 3 to one another.

Figure 4:
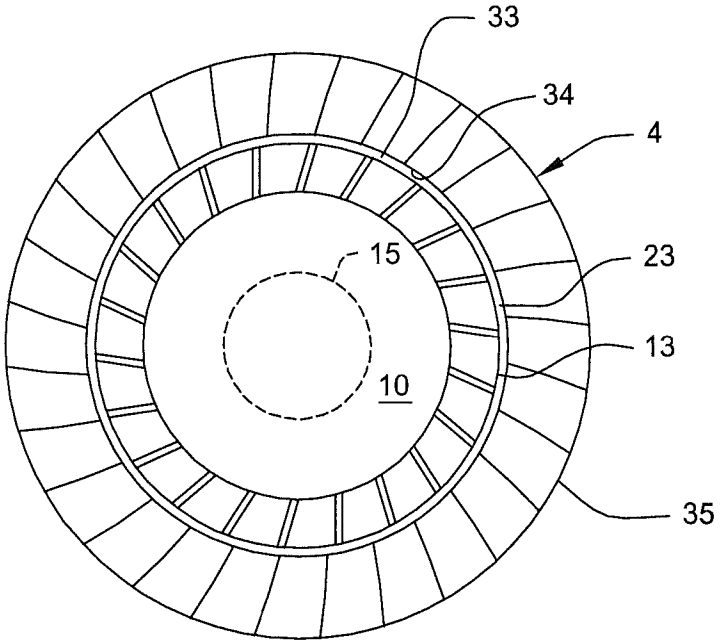
FIG. 4 is a cross-sectional view taken along lines of the sliding hand guide positioned about the first extension member as illustrated in FIG. 1.

As illustrated in FIG. 4 the exterior diameter of body 13 is smaller than the interior diameter of passageway 33 formed by the interior wall surface 34 of hand guide member 4 to form a circular gap 23 between the two. It is preferred that gap 23 be 0.125-0.25 inches to allow hand guide member 4 to glide up and down members 3 without binding and thus provide substantial flexibility and ease for an operator to continually place the hand guide member 4 at changing positions that best allows operation of the dusting and cleaning apparatus 1. In a preferred embodiment hand guide member 4 can be positioned to permit the operator to balance the weight of the motor end to the weight of the dusting member end. It has been found that this not only allows longer use of the apparatus 1 with less fatigue, particularly, when dusting or cleaning a surface located above the head of the operator, but to permit the operator to more accurately feel through his hand positioned on the guide member 4 the vibration caused by the dusting member 5 exerting force against the surface being dusted or cleaned. Guide member 4 has a length, preferably 3-9 inches, sufficient to permit easy gripping by a person's hand. The exterior surface 35 of hand guide member 4 may be shaped to provide a better gripping surface for the hand of the apparatus operator.

Figure 6:
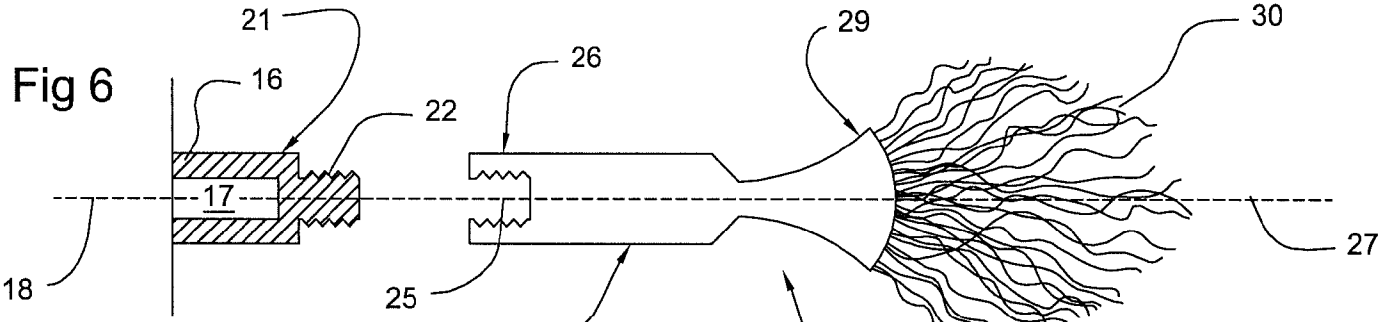
FIG. 6 is a cross-sectional view of the pivot connector to permit the dusting member to be fixed at an angle to the central axis of the second extension member.

Dusting member 5 includes an elongated body 24 having a threaded opening 25 in one end section 26 and extending parallel to the central axis 27. Opening 25 is sized to operatively receive threaded shaft 15 of member 3A, or as illustrated in FIG. 6 if more than one extension member 3 are used, to operative receive threaded shaft 22 of member 3B. In a preferred embodiment axis 18 and axis 27 are in the same straight line and each becomes the central axis for both member 3B and dusting member 5. Dusting member 5 also includes a neck section 28 extending from end section 26 and having dusting fiber connection end 29. A multitude of flexible, thin dusting elements 30 are attached to and extend outward from connection end 29. In a preferred embodiment each dusting elements 30 is constructed from a split-tipped soft poly fibers, and more preferably fibers that are 0.015625-0.0625 inches in diameter and 0.5-6.0 inches in length. Dusting elements 30 can constructed and positioned on connection end 29 to form a variety of shapes, such as conical, hemispherical, or pyramidal. However, in a still further preferred embodiment the dusting elements 30 having varying lengths and are attached to connection end 29 to form a generally bulbous shape such as illustrated in FIG. 6. In addition to dusting elements 30 having multiple shapes they can be constructed of other materials that may be more suitable to the surface being dusted or cleaned. One advantage of this invention is the ability to interchange dusting members having different dusting elements so as to allow selection of a dusting member specifically adopted for the dusting or cleaning purpose selected.

Figure 7:
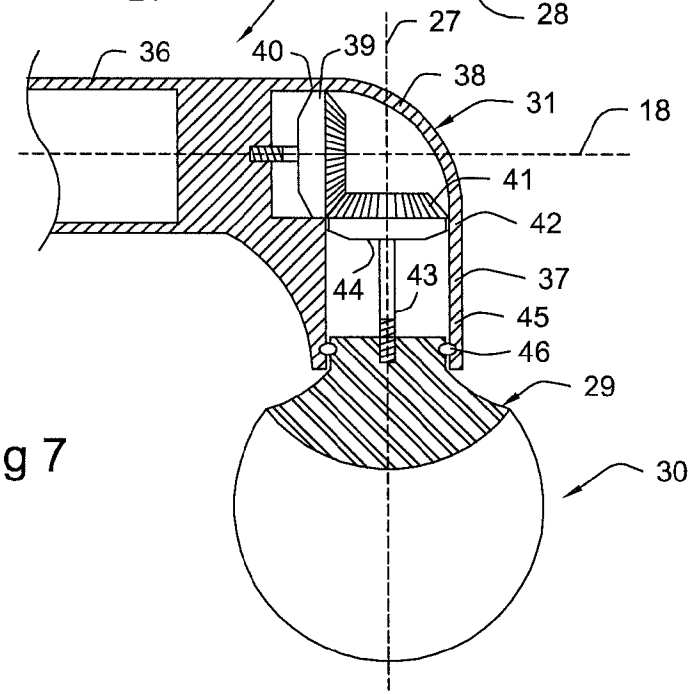
FIG. 7 is a cut-away view of a pivoting mid-section forming part of the body of the dusting member illustrating use of a worm gear assembly to permit the dusting elements to continue to rotate about the central axis of the pivoted section of the dusting member.

As illustrated in FIG. 7 dusting member body 24 may in another preferred embodiment have an elbow shaped mid-section 31 that permits axis 27 to be positioned at an angle to axis 18. In this embodiment a conventional worm gear assembly 32 is operatively affixed within mid-section 31 whereby dusting elements 30 can be rotated about axis 27. In this embodiment dusting member body 24 is constructed having a first end section 36, a second end section 37 and a third elbow shaped section 38 that fixes the first and second end sections 36, 37, respectively, at a predetermined angle to one another. In a preferred embodiment section 38 is constructed in a conventional manner to permit the predetermined angle to be changed. Worm gear 39 is fixedly seated at the end 40 of section 36 so that it rotates about axis 18 when dusting member body 24 rotates. Worm gear 41 is seated at the end 42 of section 37 whereby worm gear 41 operatively engages worm gear 39 to cause worm gear 41 to rotate about axis 27 in synchronization with, but at a predetermined angle to worm gear 39. Worm gear 41 has an axle member 43 extending along axis 27 and perpendicularly from back surface 44 of worm gear 41 that is fixed to connection end 29. Connection end 29 is seated in the opposing end 45 of section 37 in a known conventional manner; e.g., ball bearing ring 46, to permit connection end 29 to rotate about axis 27 when worm gear 41 rotates. In this manner dusting elements 30 can be positioned to rotate about axis 27 to allow more efficient contact with surfaces located above the operator's head or the underside of tables and similar objects.

In operation dusting member 5 is screwed to extension member 3. Next, hand guide member 4 is glidingly positioned about extension member 3, and then extension member 3 is attached to drill chuck 6. The operator can then adjust drill 2 to the desired torque setting. If drill 2 has a separate speed control independent of trigger 7 the speed control can also be set to the desired speed. In many drills 2 the degree that trigger 7 is squeezed controls the rotation speed of chuck 7. The operator grips and positions the hand guide member 4 with one hand to obtain the desired balance and control of the apparatus 1, and then squeezes trigger 7 with his other hand to start chuck 6 rotating. The rotation of chuck 6 causes synchronized rotation of extension member 3 and dusting member 5. Finally, the dusting elements 30 are positioned in contact with the surface area to be dusted. It has been found that use of apparatus 1 can result in >70% reduction in the time required to clean various surfaces such as baseboards or various surfaces having crevices or three-dimensional surface images.

In a preferred embodiment a cleaning or polishing compound may be applied to dusting elements 30 whereby a surface can be dusted, cleaned or polished simultaneously when contacted by dusting elements 30. This versatility permits the apparatus to be used as a multi-purpose dusting, cleaning or polishing device.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What I claim is:

1. A hand held apparatus for dusting, comprising:

a. an elongated extension member having an exterior surface of generally uniform diameter and operatively attachable at one end to a motor to cause the elongated extension member to rotate, wherein the elongated extension member comprises at least two segments attachable to one another; each segment having a first end constructed having a male connector and an opposite end constructed having a female connector shaped to receive the male connector;

b. a hand guide member constructed to fit about and to slide along the elongated extension member, wherein the hand guide member is constructed having a passageway extending through the hand guide member, wherein the passageway has a diameter of about 0.125-0.25 inches greater than the generally uniform diameter of the elongated extension member to permit the hand guide member to slide along the exterior surface of the extension member without binding; and c. a dusting member operatively attachable to an opposite end of the elongated extension member to cause the dusting member to rotate.

2. The hand held apparatus according to claim 1, wherein the elongated extension member has a length of the height of a person extending from their feet to approximately their knee.

3. The hand held apparatus according to claim 2, wherein the length is 24 inches to 36 inches long.

4. The hand held apparatus according to claim 1, wherein the elongated extension member is constructed from a non-electricity conducting material.

5. The hand held apparatus according to claim 1 wherein the male connector comprises a threaded section and the female connector comprises a threaded recess shaped to operatively receive the threaded section.

6. The hand held apparatus according to claim 5 wherein the threaded section is screwed into the threaded recess in the same direction as the extension member is rotatable during operation.

7. The hand held apparatus according to claim 1 wherein the hand guide member is constructed from a non-electricity conducting material.

8. The hand held apparatus according to claim 1 wherein the hand guide member has a length greater than the width of a hand of a person operating the hand held apparatus.

9. The hand held apparatus according to claim 8 wherein the hand guide member length is 3 inches to 9 inches.

10. The hand held apparatus according to claim 1 wherein the dusting member comprises a body section and a head section; the body section constructed to be attachable to the opposite end of the elongated extension member; the head section attachable to the body section and comprising multiple strands of synthetic fiber.

11. The hand held apparatus according to claim 10 wherein the multiple strands have a diameter between 0.015625 to 0.0625 inches.

12. The hand held apparatus according to claim 10 wherein each of the multiple strands has a length of 0.5-6.0 inches.

13. The hand held apparatus according to claim 10 wherein at least a portion of strands have a cleaning compound adhered to or absorbed in the synthetic fiber.

* * * * *